US010705484B2

(12) United States Patent
Oshikawa et al.

(10) Patent No.: US 10,705,484 B2
(45) Date of Patent: Jul. 7, 2020

(54) DEVELOPING DEVICE, PROCESS CARTRIDGE, AND IMAGE FORMING APPARATUS

(71) Applicants: Yuki Oshikawa, Kanagawa (JP); Yoshihiro Fujiwara, Kanagawa (JP); Naohiro Kawashima, Kanagawa (JP); Ryusuke Mase, Kanagawa (JP); Yuuki Tsuchiya, Tokyo (JP)

(72) Inventors: Yuki Oshikawa, Kanagawa (JP); Yoshihiro Fujiwara, Kanagawa (JP); Naohiro Kawashima, Kanagawa (JP); Ryusuke Mase, Kanagawa (JP); Yuuki Tsuchiya, Tokyo (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 16/575,384

(22) Filed: Sep. 19, 2019

(65) Prior Publication Data

US 2020/0103824 A1 Apr. 2, 2020

(30) Foreign Application Priority Data

Sep. 28, 2018 (JP) ..... 2018-183958

(51) Int. Cl.
*G03G 15/08* (2006.01)
*G03G 21/20* (2006.01)

(52) U.S. Cl.
CPC ..... *G03G 21/206* (2013.01); *G03G 15/0822* (2013.01)

(58) Field of Classification Search
CPC ..... G03G 15/0822; G03G 21/206
See application file for complete search history.

(56) References Cited

U.S. PATENT DOCUMENTS 5,771,426 A * 6/1998 Oka ..... G03G 15/0822 399/119
5,848,326 A * 12/1998 Komuro ..... G03G 15/0822 399/98

(Continued)

FOREIGN PATENT DOCUMENTS

JP 2013-148875 8/2013
JP 2014-132322 7/2014

(Continued)

OTHER PUBLICATIONS

Extended European Search Report dated Feb. 6, 2020, issued in corresponding European Patent Application No. 19196642.3, 5 pages.

*Primary Examiner* — David J Bolduc
(74) *Attorney, Agent, or Firm* — Xsensus LLP

(57) ABSTRACT

A developing device includes a developing roller, a cover to cover the developing roller from above the developing roller, a filter to cover a vent of the cover to filter air and collect toner passing through the vent, and a pressing member engaged with the cover in which the filter is installed. The cover includes a projecting support to support the filter. The pressing member holds the filter between the pressing member and the cover. The projecting support is projected from one end toward the other end of the vent in a transverse direction of the vent at a part of the cover in a longitudinal direction of the developing roller to block the vent, and cantilevered on the one end. A gap is provided between a tip of the projecting support and an inner edge of the cover on the other end.

10 Claims, 8 Drawing Sheets

XIIB–XIIB

(56) References Cited

U.S. PATENT DOCUMENTS 5,923,922 A * 7/1999 Ishida ..... G03G 15/065 399/53
5,987,298 A * 11/1999 Muramatsu ..... G03G 21/105 399/260
7,139,502 B2 * 11/2006 Koishi ..... G03G 21/1814 399/93
10,175,649 B1 * 1/2019 Stafford ..... G03G 21/206
2004/0052545 A1 * 3/2004 Satoh ..... G03G 21/203 399/92
2006/0072933 A1 * 4/2006 Miyamoto ..... G03G 21/206 399/92
2007/0065171 A1 * 3/2007 Koshimura ..... G03G 15/0898 399/99
2007/0081832 A1 * 4/2007 Yoshida ..... G03G 15/0822 399/254
2009/0074466 A1 * 3/2009 Kwon ..... G03G 15/0898 399/252
2011/0008067 A1 * 1/2011 Okada ..... G03G 21/10 399/92
2011/0008068 A1 1/2011 Kunihiro et al.
2013/0064567 A1 * 3/2013 Akama ..... G03G 21/206 399/90
2014/0270838 A1 * 9/2014 Yoshizawa ..... G03G 15/0893 399/99
2014/0376951 A1 12/2014 Ogawa et al.
2015/0362861 A1 12/2015 Oshikawa et al.
2016/0026119 A1 * 1/2016 Ohashi ..... G03G 21/12 399/358
2017/0227891 A1 * 8/2017 Shibata ..... G03G 15/0907
2017/0293257 A1 10/2017 Ohhira et al.
2017/0336734 A1 * 11/2017 Nagashima ..... G03G 15/0891
2017/0351195 A1 12/2017 Koshizuka et al.
2018/0039226 A1 * 2/2018 Takeuchi ..... G03G 21/1814
2018/0120731 A1 * 5/2018 Nakamura ..... G03G 15/0808
2018/0129150 A1 5/2018 Taniguchi et al.
2018/0136586 A1 * 5/2018 Tsuchiya ..... G03G 15/0881
2018/0143568 A1 * 5/2018 Ohhira ..... G03G 15/0893
2018/0267427 A1 * 9/2018 Kuramoto ..... G03G 15/0822
2019/0018343 A1 1/2019 Oshikawa
2019/0294066 A1 * 9/2019 Koide ..... G03G 9/08755

FOREIGN PATENT DOCUMENTS

JP 2016-148826 6/2016
JP 2017-021089 1/2017

* cited by examiner

XIIA-XIIA

XIIB-XIIB

DEVELOPING DEVICE, PROCESS CARTRIDGE, AND IMAGE FORMING APPARATUS

CROSS-REFERENCE TO RELATED APPLICATION

This patent application is based on and claims priority pursuant to 35 U.S.C. § 119(a) to Japanese Patent Application No. 2018-183958, filed on Sep. 28, 2018, in the Japan Patent Office, the entire disclosure of which is hereby incorporated by reference herein.

BACKGROUND

Technical Field

Embodiments of the present disclosure generally relate to a developing device configured to develop a latent image formed on a surface of an image bearer, a process cartridge incorporating the developing device, and an electrophotographic image forming apparatus, such as a copier, a printer, a facsimile machine, or a multifunction peripheral (MFP) having at least two of such capabilities.

Description of the Related Art

There are image forming apparatuses, such as copiers, printers, and the like, incorporating a developing device in which a cover (a casing of the developing device) is configured to cover a developing roller (a developer bearer).

SUMMARY

Embodiments of the present disclosure describe an improved developing device configured to develop a latent image formed on an image bearer. The developing device includes a developing roller opposed to or in contact with the image bearer, a cover configured to cover the developing roller from above the developing roller, a filter configured to cover a vent of the cover to filter air and collect toner passing through the vent, and a pressing member engaged with the cover in which the filter is installed. The vent allows ventilation of the developing device. The pressing member is configured to hold the filter between the pressing member and the cover. The cover includes a projecting support configured to support the filter. The projecting support is projected from one end of the vent in a transverse direction of the vent toward the other end of the vent in the transverse direction of the vent at a part of the cover in a longitudinal direction of the developing roller to block the vent, and cantilevered by the cover on the one end in the transverse direction. A gap is provided between a tip of the projecting support and an inner edge of the cover on the other end of the vent in the transverse direction.

BRIEF DESCRIPTION OF THE SEVERAL VIEWS OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
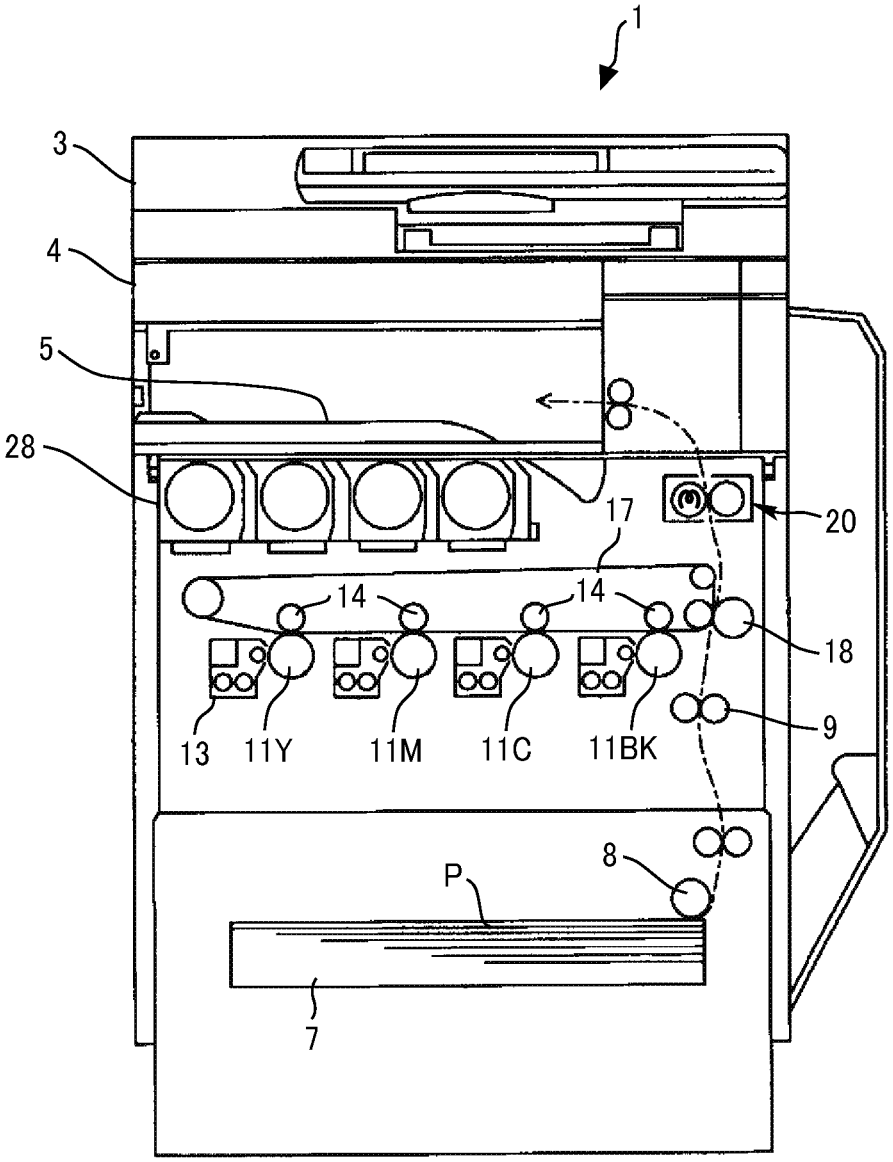
FIG. 1 is a schematic view illustrating a configuration of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted. In addition, identical or similar reference numerals designate identical or similar components throughout the several views.

DETAILED DESCRIPTION

Embodiments of the present disclosure are described in detail with reference to drawings. It is to be understood that identical or similar reference numerals are assigned to identical or corresponding components throughout the drawings, and redundant descriptions are omitted or simplified below as required.

In describing embodiments illustrated in the drawings, specific terminology is employed for the sake of clarity. However, the disclosure of this patent specification is not intended to be limited to the specific terminology so selected, and it is to be understood that each specific element includes all technical equivalents that have the same function, operate in a similar manner, and achieve a similar result.

As used herein, the singular forms "a", "an", and "the" are intended to include the plural forms as well, unless the context clearly indicates otherwise.

It is to be noted that the suffixes Y, M, C, and K attached to each reference numeral indicate only that components indicated thereby are used for forming yellow, magenta, cyan, and black images, respectively, and hereinafter may be omitted when color discrimination is not necessary.

With reference to FIG. 1, a configuration and operation of an image forming apparatus 1 is described below.

In FIG. 1, the image forming apparatus 1, which is a tandem color copier in the present embodiment, includes a document conveyance device 3, a document scanner 4, an output tray 5, a sheet feeding device 7, and a registration roller pair (a timing roller pair) 9. The document conveyance device 3 conveys a document to the document scanner 4. The document scanner 4 reads image data for the document. The output tray 5 stacks output images. The sheet feeding device 7 contains sheets P such as paper sheets. The registration roller pair 9 adjusts the timing of conveyance of the sheet P.

The image forming apparatus 1 also includes photoconductor drums 11Y, 11M, 11C, and 11BK as image bearers, developing devices 13, primary transfer rollers 14, and an intermediate transfer belt 17 as an intermediate transferor. Electrostatic latent images are formed on surfaces of the photoconductor drums 11Y, 11M, 11C, and 11BK and developed into toner images of yellow, magenta, cyan, and black by the developing devices 13. The toner images on the surfaces of the photoconductor drums 11Y, 11M, 11C, and 11BK are transferred to and superimposed on the intermediate transfer belt 17 by the primary transfer rollers 14, thereby forming a multicolor toner image on the intermediate transfer belt 17.

The image forming apparatus 1 further includes a secondary transfer roller 18, a fixing device 20, and toner containers 28. The secondary transfer roller 18 transfers the multicolor toner image on the intermediate transfer belt 17 onto the sheet P. The fixing device 20 fixes the multicolor toner image (unfixed image) on the sheet P. The toner containers 28 contain yellow, magenta, cyan, and black toners to supply the toners to the developing devices 13.

A description is provided below of operation of the image forming apparatus 1 when forming a normal color image.

Figure 2:
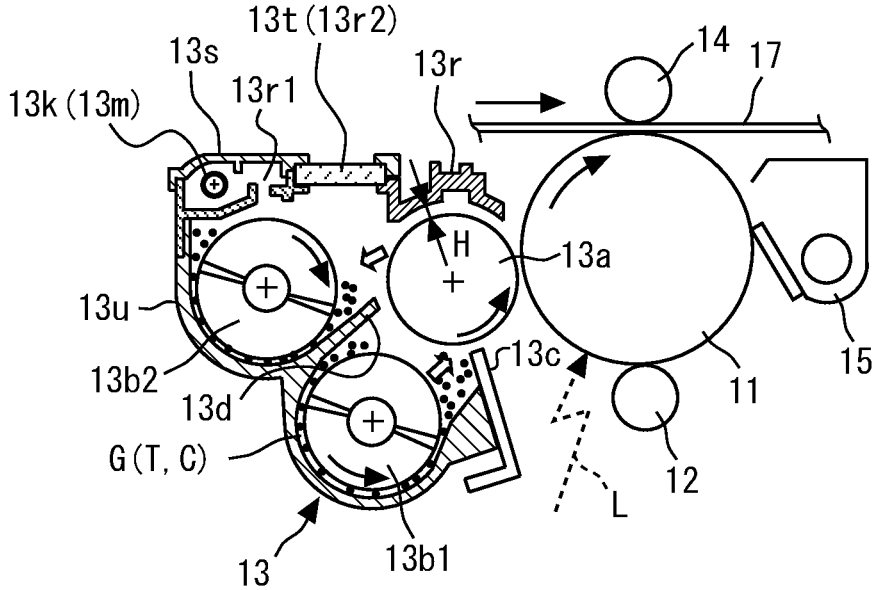
FIG. 2 is a schematic diagram illustrating a configuration of an image forming unit included in the image forming apparatus illustrated in FIG. 1.

It is to be noted that FIG. 2 is also referred to when image forming process performed on the respective photoconductor drums 11Y, 11M, 11C, and 11BK (hereinafter, also collectively referred to as "photoconductor drums 11") is described.

A conveyance roller of the document conveyance device 3 conveys a document on a document table onto an exposure glass of the document scanner 4. Then, the document scanner 4 optically scans image data for the document on the exposure glass.

More specifically, the document scanner 4 scans an image of the document on the exposure glass with light emitted from an illumination lamp. The light reflected from a surface of the document is directed onto a color sensor via mirrors and lenses to form multicolor image data. The multicolor image data for the document, which is decomposed into red, green, and blue (RGB) data, is read by the color sensor and converted into electrical image signals. Further, an image processor performs image processing (e.g., color conversion, color calibration, and spatial frequency adjustment) according to the image signals of the decomposed RGB data, and thus image data for yellow, magenta, cyan, and black toner images are obtained.

The image data for yellow, magenta, cyan, and black toner images are sent to a writing device. The writing device directs a laser beam L (see FIG. 2) onto a surface of the corresponding photoconductor drum 11 according to image data for each color.

Meanwhile, the four photoconductor drums 11 rotate clockwise as illustrated in FIGS. 1 and 2. Initially, the surface of each photoconductor drum 11 is uniformly charged by a charging device 12 (see FIG. 2) at a position opposite the charging device 12 (a charging process). Thus, the surface of the photoconductor drum 11 is charged to a certain potential. Subsequently, the charged surface of the photoconductor drum 11 reaches a position where the surface is scanned by the laser beam L.

The writing device emits the laser beam L from each of four light sources according to the image data. The respective laser beams L pass through different optical paths for the different components of yellow, magenta, cyan, and black (an exposure process).

The laser beam L corresponding to the yellow component is directed onto the surface of the photoconductor drum 11Y that is the first from the left in FIG. 1 among the four photoconductor drums 11Y, 11M, 11C, and 11K. A polygon mirror that rotates at high velocity deflects the laser beam L for yellow along the axis of rotation of the photoconductor drum 11 (i.e., the main-scanning direction) so that the laser beam L scans the surface of the photoconductor drum 11. Thus, an electrostatic latent image for yellow is formed on the surface of the photoconductor drum 11 charged by the charging device 12.

Similarly, the laser beam L corresponding to the magenta component is directed onto the surface of the photoconductor drum 11M that is the second from the left in FIG. 1, thus forming an electrostatic latent image for magenta thereon. The laser beam L corresponding to the cyan component is directed onto the surface of the photoconductor drum 11C that is the third from the left in FIG. 1, thus forming an electrostatic latent image for cyan thereon. The laser beam L corresponding to the black component is directed onto the surface of the photoconductor drum 11BK that is the fourth from the left in FIG. 1, thus forming an electrostatic latent image for black thereon.

Then, the surface of the photoconductor drum 11 having the electrostatic latent image reaches a position opposite the developing device 13. The developing device 13 supplies toner of each color to the photoconductor drum 11 and develops the electrostatic latent image on the photoconductor drum 1 into a visible toner image (a development process).

Subsequently, the surfaces of the photoconductor drums 11 reach positions facing the intermediate transfer belt 17. The primary transfer rollers 14 are disposed at positions where the photoconductor drums 11 face the intermediate transfer belt 17 and in contact with an inner surface of the intermediate transfer belt 17, respectively. At the positions of the primary transfer rollers 14, the toner images on the photoconductor drums 11Y, 11M, 11C, and 11BK are transferred to and superimposed on the intermediate transfer belt 17, forming a multicolor toner image thereon (a primary transfer process).

After the primary transfer process, the surface of the photoconductor drum 11 reaches a position opposite a cleaning device 15. The cleaning device 15 collects untransferred toner remaining on the photoconductor drum 11 (a cleaning process).

Then, the surface of the photoconductor drum 11 passes through the discharger to complete a series of image forming processes performed on the photoconductor drum 11.

The multicolor toner image is formed on a surface of the intermediate transfer belt 17 by transferring and superimposing the respective single-color toner images formed on the photoconductor drums 11. Then, the intermediate transfer belt 17 carrying the multicolor toner image moves counterclockwise in FIG. 1 to reach a position opposite the secondary transfer roller 18 (i.e., a secondary transfer nip). The secondary transfer roller 18 secondarily transfers the multicolor toner image carried on the intermediate transfer belt 17 onto the sheet P (a secondary transfer process).

After the secondary transfer process, the surface of the intermediate transfer belt 17 reaches a position opposite a belt cleaning device. The belt cleaning device collects untransferred toner adhering to the intermediate transfer belt 17 to complete a sequence of transfer processes performed on the intermediate transfer belt 17.

The sheet P is conveyed from the sheet feeding device 7 via the registration roller pair 9 to the secondary transfer nip between the intermediate transfer belt 17 and the secondary transfer roller 18.

More specifically, a sheet feeding roller 8 feeds the sheet P from the sheet feeding device 7 that contains multiple sheets P, and the sheet P is then guided by a sheet guide to the registration roller pair 9. The sheet P that has reached the registration roller pair 9 is conveyed toward the secondary transfer nip, timed to coincide with the arrival of the multicolor toner image on the intermediate transfer belt 17.

Then, the sheet P carrying the multicolor toner image is conveyed to the fixing device 20. The fixing device 20 includes a fixing roller and a pressure roller pressing against each other. In a nip between the fixing roller and the pressure roller, the multicolor toner image is fixed on the sheet P.

After the fixing process, an output roller pair ejects the sheet P as an output image outside the image forming apparatus 1, and the ejected sheet P is stacked on the output tray 5. Thus, a series of the image forming processes is completed.

Next, an image forming unit of the image forming apparatus 1 is described in further detail below with reference to FIGS. 2 to 4.

FIG. 2 is a schematic view illustrating a configuration of the image forming unit. FIG. 3 is a horizontal schematic cross-sectional view of the developing device 13 as viewed in the longitudinal direction of the developing device 13. FIG. 3 illustrates a circulation path of a developer in the developing device 13. In a part (a) of FIG. 3, a second conveyance screw **13*b*2 as a conveyor for collecting the developer is disposed in a collection path of an upper portion of the developing device 13. In a part (b) of FIG. 3, a first conveyance screw 13*b*1 as a conveyor for supplying the developer is disposed in a supply path of a lower portion of the developing device 13. FIG. 4 is a vertical schematic cross-sectional view illustrating the circulation path of the developer in the developing device 13 as viewed in the longitudinal direction of the developing device 13**.

Figure 3:
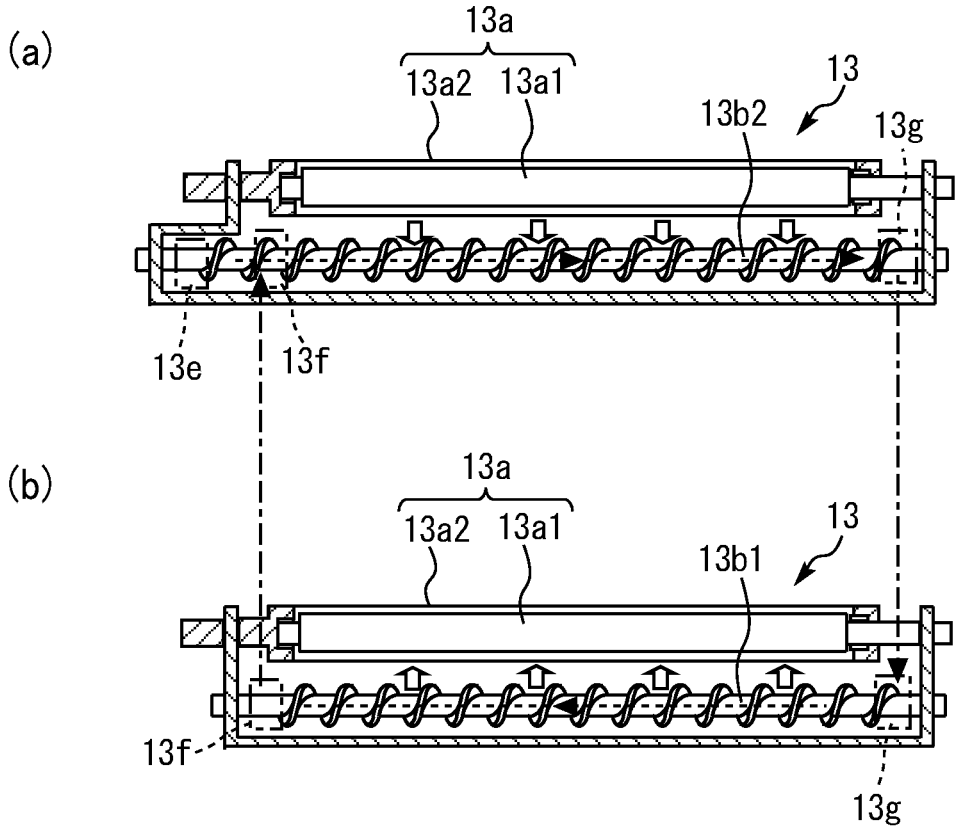
FIG. 3 is a schematic cross-sectional view of a developing device of the image forming unit in FIG. 2 as viewed in a longitudinal direction of the developing device.
Figure 4:
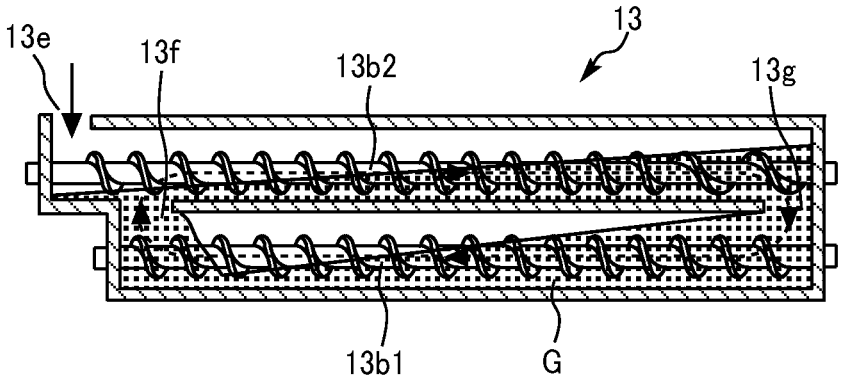
FIG. 4 is a schematic cross-sectional view illustrating a circulation path of the developing device in FIG. 3 as viewed in the longitudinal direction of the developing device.

It is to be noted that the suffixes Y, M, C, and BK of the photoconductor drum 11, the developing device 13, and the like are omitted in FIGS. 2 to 4 and the like for simplicity because the image forming units have a similar configuration.

As illustrated in FIG. 2, each image forming unit includes the photoconductor drum 11 as the image bearer, the charging device 12, the developing device 13, the cleaning device 15, and the like.

The photoconductor drum 11 as the image bearer in the present embodiment is a negatively-charged organic photoconductor and is rotated clockwise in FIG. 2 by a drive motor.

The charging device 12 is an elastic charging roller and can be formed by coating a core with an elastic layer of moderate resistivity, such as foamed urethane, that includes carbon black as conductive particles, a sulfuration agent, a foaming agent, and the like. The material of the elastic layer of moderate resistivity of the charging device 12 includes, but is not limited to, rubber such as urethane, ethylene-propylene-diene-polyethylene (EPDM), acrylonitrile butadiene rubber (NBR), silicone rubber, and isoprene rubber to which a conductive material such as carbon black or metal oxide is added to adjust the resistivity. Alternatively, foamed rubber including these materials may be used.

The cleaning device 15 includes a cleaning blade that slidingly contacts the surface of the photoconductor drum 11 and mechanically removes untransferred toner on the photoconductor drum 11.

The developing device 13 includes a developing roller **13*a*, serving as a developer bearer, opposed to the photoconductor drum 11 with a slight gap, and a development range (a development nip) where a magnetic brush formed on the developing roller 13*a* contacts the photoconductor drum 11 is formed in a portion where the developing roller 13*a* is opposed to the photoconductor drum 11. The developing device 13 contains a two-component developer G including toner T and carrier C. The developing device 13 develops the electrostatic latent image on the photoconductor drum 11 into the toner image. The configuration and operation of the developing device 13** are described in further detail later.

With reference to FIG. 1, the toner containers 28 contain the toner T to be supplied to the developing devices 13. Specifically, the developing device 13 includes a magnetic sensor to detect toner concentration (i.e., a ratio of toner T to the developer G). According to the toner concentration detected by the magnetic sensor, the toner T is supplied from the toner container 28 to the developing device 13 via a toner conveyance tube and a toner supply inlet **13*e* (see FIGS. 3 and 4**).

In the present embodiment, any toner can be used as the toner T in the developer G and the toner T in the toner container 28, and any carrier can be used as the carrier C in the developer G.

Next, the developing device 13 of the image forming apparatus 1 is described in further detail below.

With reference to FIGS. 2 to 4, the developing device 13 includes the developing roller **13*a* serving as the developer bearer, a first conveying screw 13*b*1 and a second conveying screw 13*b*2 (i.e., auger screws) serving as the conveyors, and a doctor blade 13*c*** serving as a developer regulator.

The developing roller **13*a* includes a cylindrical sleeve 13*a*2 made of a nonmagnetic material and rotates counterclockwise in FIG. 2 by a drive motor as a driver. The nonmagnetic material includes, but is not limited to, aluminum, stainless steel, brass, and conductive resin. With reference to FIG. 3, a magnet 13*a*1 is secured inside the sleeve 13*a*2 of the developing roller 13*a* and generates multiple magnetic poles around a circumferential surface of the sleeve 13*a*2. The developer G carried on the developing roller 13*a* is transported to the doctor blade 13*c* along with rotation of the developing roller 13*a* in the counterclockwise direction indicated by the arrow in FIG. 2. An amount of developer G on the developing roller 13*a* is adjusted to the suitable amount by the doctor blade 13*c*, after which the developer G is transported to the development range opposite the photoconductor drum 11. Then, the toner in the developer G is attracted to the latent image formed on the photoconductor drum 11** due to the effect of an electric field for development generated in the development range.

Specifically, a scooping pole of the multiple magnetic poles acts on magnetic carrier C in the developer G, and thus the developer G contained in the supply path of the developing device 13 is partially scooped up on the developing roller **13*a* A part of the developer G carried on the developing roller 13*a* is scraped off by the doctor blade 13*c* and returned to the supply path. The developer G passes through a doctor gap between the doctor blade 13***c* and the developing roller 13*a* where the scooping pole acts. Then, the grains of the developer G carried on the developing roller 13*a* stand on end on the developing roller 13*a* due to the magnetic force exerted by a main pole of the multiple magnetic poles, forming a magnetic brush in the development range and slidingly contact the photoconductor drum 11. Thus, the toner T in the developer G carried on the developing roller 13*a* adheres to the latent image formed on the photoconductor drum 11. After passing through the development range where the main pole acts, the developer G passes between an upper cover 13*r* and the developing roller 13*a* by the magnetic force exerted by a conveyance pole of the multiple magnetic poles and is transported to a position corresponding to a developer release pole of the multiple magnetic poles. Then, at the position corresponding to the developer release pole, magnetic repulsion to separate the developer G from the developing roller 13*a* acts on the carrier C, and the developer G carried on the developing roller 13*a* after the development process is removed from the developing roller 13*a* Then, the developer G drops into the collection path of the developing device 13 and is transported downstream by the second conveying screw 13*b*2 therein.

With reference to FIG. 2, the doctor blade 13*c* as the developer regulator is a nonmagnetic plate disposed below the developing roller 13*a*. Alternatively, a portion of the doctor blade 13*c* can be made of a magnetic material. The doctor blade 13*c* is opposed to the developing roller 13*a* below the developing roller 13*a*, serving as the developer regulator to adjust the amount of the developer G carried on the developing roller 13*a*.

In FIG. 2, the developing roller 13*a* rotates counterclockwise, and the photoconductor drum 11 rotates clockwise.

The first and second conveying screws 13*b*1 and 13*b*2 stir the developer G contained in the developing device 13 while circulating the developer G in the longitudinal direction of the developing device (hereinafter also referred to as "developer conveyance direction"), perpendicular to the surface of the paper on which FIG. 2 is drawn.

The first conveying screw 13*b*1 as the conveyor for supplying the developer is opposed to the developing roller 13*a* and supplies the developer G to the developing roller 13*a* as indicated by white arrows illustrated in the part (b) of FIG. 3 at the position corresponding to the scooping pole while horizontally transporting the developer G in the developer conveyance direction to the left in the FIG. 3 as indicated by a broken arrow illustrated in the part (b) of FIG. 3. The first conveying screw 13*b*1 rotates counterclockwise in FIG. 2.

The second conveying screw 13*b*2 as the conveyor for collecting the developer G is disposed above the first conveying screw 13*b*1 and opposed to the developing roller 13*a*. The second conveying screw 13*b*2 horizontally transports the developer G that has been forcibly separated from the developing roller 13*a* by the developer release pole in the direction indicated by white arrows in the part (a) of FIG. 3 to the right in FIG. 3 as indicated by a broken arrow illustrated in the part (a) of FIG. 3. In the present embodiment, the second conveying screw 13*b*2 rotates in the direction opposite to the developing roller 13*a* (i.e., clockwise in FIG. 2).

The developer G is transported from the downstream side of the supply path (hereinafter, also referred to as "a first transport path") in which the first conveying screw 13*b*1 is disposed, through a first communication opening 13*f*, and to the collection path (hereinafter, also referred to as "a second transport path") in which the second conveying screw 13*b*2 is disposed. The second conveying screw 13*b*2 transports the developer G downstream in the collection path (the second transport path) and to the upstream side of the supply path (the first transport path) through a second communication opening 13*g* (as indicated by alternate long and short dashed arrow in FIG. 3).

The first and second conveying screws 13*b*1 and 13*b*2 are disposed so that axes of rotation of the first and second conveying screws 13*b*1 and 13*b*2 are substantially horizontal similar to the developing roller 13*a* and the photoconductor drum 11. Each of the first and second conveying screws 13*b*1 and 13*b*2 includes a screw shaft and a helical blade winding around the screw shaft.

The first and second conveying screws 13*b*1 and 13*b*2 and the developing roller 13*a* constitute a drive system with a gear train and are driven to rotate by the drive motor as the driver. That is, a controller controls the drive motor to rotate the first and second conveying screws 13*b*1 and 13*b*2 along with the developing roller 13*a*.

Specifically, a coupling to which the driving force is directly transmitted from the drive motor is disposed on a shaft on one end of the developing roller 13*a* in the longitudinal direction of the developing roller 13*a* (i.e., the direction perpendicular to the surface of the paper on which FIG. 2 is drawn and the left and right direction in FIG. 3). Further, a gear is disposed on the shaft on the one end of the developing roller 13*a* in the longitudinal direction, and the gear meshes with a gear disposed on a shaft on one end of the first conveying screw 13*b*1 in the longitudinal direction via an idler. In addition, a first gear 13*x* is disposed on the shaft on the other end of the first conveying screw 13*b*1 in the longitudinal direction and meshes with a second gear 13*y* disposed on the shaft portion at the other end of the second conveying screw 13*b*2 in the longitudinal direction (see FIGS. 6 and 7). Here, a third gear (a following gear) 13*z* attached to a winding shaft 13*k* meshes with the second gear (a driving gear) 13*y*, which is described in detail later.

In the present embodiment, the drive motor as the driver to drive the developing device 13 is provided independently of the drive motor to rotate the photoconductor drum 11.

An inner wall (a partition) 13*d* of the developing device 13 separates the first transport path (the supply path) in which the first conveying screw 13*b*1 is disposed and the second transport path (the collection path) in which the second conveying screw 13*b*2 is disposed.

With reference to FIGS. 3 and 4, the downstream side of the second transport path (the collection path), in which the second conveying screw 13*b*2 is disposed, communicates with the upstream side of the first transport path (the supply path), in which the first conveying screw 13*b*1 is disposed, via the second communication opening 13*g*. In the downstream end portion of the second transport path, the developer G falls through the second communication opening 13*g* to the upstream end portion of the first transport path.

With reference to FIGS. 3 and 4, the downstream side of the first transport path, in which the first conveying screw 13*b*1 is disposed, communicates with the upstream side of the second transport path, in which the second conveying screw 13*b*2 is disposed, via the first communication opening 13*f*. In the first transport path, the developer G that is not supplied to the developing roller 13*a* accumulates adjacent to the first communication opening 13*f* and then is transported or supplied via the first communication opening 13*f* to the upstream end portion of the second transport path.

It is to be noted that a paddle or a screw winding in the direction opposite to the helical blade of the first conveying screw 13*b*1 may be provided on a downstream portion of the first conveying screw 13*b*1 to facilitate conveyance of the developer G at a position corresponding to the first communication opening 13*f*, which is conveyance from the supply path to the collection path against the direction of gravity.

This configuration provides the circulation path through which the developer G is circulated in the longitudinal direction by the first and second conveying screws 13*b*1 and 13*b*2 in the developing device 13. That is, when the developing device 13 operates, the developer G contained therein flows in the developer conveyance direction indicated by the broken arrows illustrated in FIGS. 3, and 4. Separating the first transport path (the supply path), in which the first conveying screw 13*b*1 supplies the developer G to the developing roller 13*a*, from the second transport path (the collection path), to which the developer G is collected from the developing roller 13*a* by the second conveying screw 13*b*2, can reduce density unevenness of toner images formed on the photoconductor drum 11.

The magnetic sensor to detect the toner concentration in the developer G circulated in the developing device 13 is disposed in the collection path (the second transport path). Based on the toner concentration detected by the magnetic sensor, the fresh toner T is supplied from the toner container 28 to the developing device 13 through the toner supply inlet 13*e* disposed near the first communication opening 13*f*.

Additionally, with reference to FIGS. 3 and 4, the toner supply inlet 13*e* is disposed above an upstream side portion of the second transport path, in which the second conveying screw 13*b*2 is disposed, away from the development range, that is, disposed outside the area occupied by the developing roller 13*a* in the longitudinal direction. Since the toner supply inlet 13*e* is disposed near of the first communication opening 13*f*, the developer G separated from the developing roller 13*a* falls on the supplied toner T, which has a small specific gravity, in the collection path, and the supplied toner T is sufficiently dispersed in and mixed with the developer G over a relatively extended period of time toward the downstream side of the collection path.

It is to be noted that the position of the toner supply inlet 13*e* is not limited to inside the collection path (the second transport path) but can be disposed above an upstream portion of the supply path, for example.

In the present embodiment, the replaceable developing device 13 is removably installed in the image forming apparatus 1 and replaced with a new one (which may be a recycled product) in a predetermined replacement cycle.

Figure 5A:
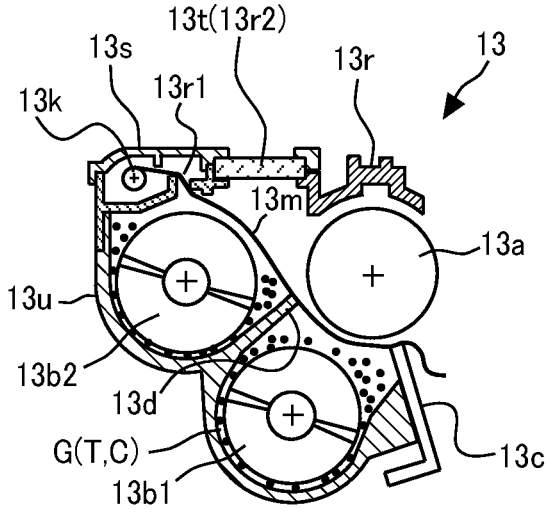
FIG. 5A is a schematic cross-sectional view of a new developing device at the time of factory shipment according to an embodiment of the present disclosure.
Figure 5B:
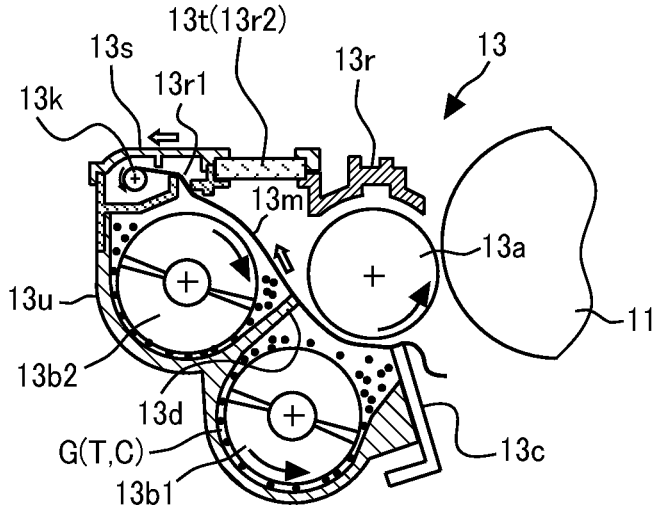
FIG. 5B is a schematic cross-sectional view of the new developing device installed in the image forming apparatus.

With reference to FIGS. 5A and 5B, the developing device 13 includes a sheet member 13*m* configured to form a closed space that contains the developer G in the developing device 13 to prevent the developer G from leaking to the outside of the developing device 13 before starting to use the developing device 13 in the image forming apparatus 1. The developing device 13 previously stores (presets) the developer G therein before factory shipment.

The developing device 13 further includes the winding shaft 13*k* configured to rotate in a predetermined direction (i.e., counterclockwise in FIG. 5B to wind the sheet member 13*m* in a direction approximately perpendicular to an axis of rotation of the winding shaft 13*k* (i.e., a winding direction). The sheet member 13*m* is removed from inside of the developing device 13 to the outside via an opening 13*r*1 when the developing device 13 starts to be used in the image forming apparatus 1.

Specifically, the sheet member 13*m* is made of a material such as polyurethane rubber having a thickness of about 0.1 to 0.5 mm and a rectangular shape, and extends in the winding direction (in the direction indicated by the white arrow in FIG. 5B). The sheet member 13*m* has a length in the longitudinal direction of the developing roller 13*a* corresponding to a range of the first and second transport paths in the longitudinal direction so as to isolate the inside of the developing device 13, and a length in the winding direction long enough to isolates the inside of the developing device 13 and be wound by the winding shaft 13*k*.

A new or recycled developing device 13 is shipped from the factory in a state in which the sheet member 13*m* is installed as illustrated in FIG. 5A. That is, in the factory, the supply path and the collection path of the developing device 13 that has been assembled (or the developing device before the developing roller 13*a* is assembled) are filled with the developer G. Thereafter, the sheet member 13*m* is installed so as to seal the supply path and the collection path so that the developer G does not leak.

Specifically, with reference to FIG. 5A, in the present embodiment, the sheet member 13*m* is disposed on a virtual plane, which is substantially straight in FIG. 5A, connecting a tip of partition 13*d* and a tip of doctor blade 13*c* in the developing device 13. One end of the sheet member 13*m* extending toward the doctor blade 13*c* and outside the developing device 13 is bonded (or heat-welded) to the exterior of the developing device 13 with a relatively light force. The other end of the sheet member 13*m* is wound around the winding shaft 13*k*, and tension is applied to the sheet member 13*m*. Thus, the developer G is prevented from leaking from the first transport path in which the first conveying screw (a supply screw) 13*b*1 is disposed.

Similarly, the sheet member 13*m* is disposed on a virtual plane, which is substantially straight in FIG. 5A, connecting the tip of the partition 13*d* and the opening 13*r*1 formed in the upper cover 13*r*. The other end of the sheet member 13*m* extending toward the winding shaft 13*k* is wound around the winding shaft 13*k*, and tension is applied to the sheet member 13*m*. Thus, the developer G is prevented from leaking from the second transport path in which the second conveying screw (a collection screw) 13*b*2 is disposed.

Note that, if the sheet member 13*m* is bonded (or heat-welded) to the tip of the partition 13*d* and the tip of the doctor blade 13*c* with a relatively light force, the sheet member 13*m* can more reliably seal the first and second transport paths in the developing device 13.

Further, with reference to FIGS. 5A and 5B (or FIGS. 6 and 7, etc.), the winding shaft 13*k* is rotatably disposed above a ceiling portion of the upper cover 13*r* (i.e., the outside relative to the inside of the developing device 13 where the developer G is contained). The upper cover 13*r* as the cover functions as an exterior or a part of the casing of the developing device 13. The end portion of sheet member 13*m* in the winding direction is secured to the winding shaft 13*k* by glue or the like so that sheet member 13*m* can be wound up on the outer circumference of winding shaft 13*k* by rotating winding shaft 13*k*.

Further, as illustrated in FIGS. 5A and 5B, the ceiling portion of the upper cover 13*r* has the substantially rectangular opening 13*r*1 that communicates between the inside and the outside of the developing device 13. The opening 13*r*1 extends in the longitudinal direction of the developing device 13 (i.e., the direction perpendicular to the surface of the paper on which FIGS. 5A and 5B are drawn. The sheet member 13*m* can be moved (wound up) from the inside of the developing device 13 to the outside through the opening 13*r*1. In the present embodiment, the opening 13*r*1 as well as a vent 13*r*2 to be described later opens in the vertical direction.

With this configuration, the developing device 13 is installed in the image forming apparatus 1 as illustrated in FIG. 5B while the developer G contained therein is sealed by the sheet member 13*m* as illustrated in FIG. 5A. There are those cases such as: (a) when the new image forming apparatus 1 in which the new developing device 13 is installed is shipped, and (b) when a new developing device 13 for replacement is installed in the image forming apparatus 1 already used by a user.

In any of the cases described above, as the winding shaft 13*k* is rotated before the use of the new developing device 13 in the image forming apparatus 1 (i.e., before the development process), the sheet member 13*m* that seals the first and second transport paths is wound by the winding shaft 13*k*. That is, as illustrated in FIG. 5B, in a state in which the developing device 13 with the sheet member 13*m* that seals the first and second transport paths is installed in the image forming apparatus 1, before the image formation (the development process), the sheet member 13*m* is moved in the direction indicated by the white arrow in FIG. 5B by rotating the winding shaft 13*k*, and is wound around the winding shaft 13*k*. Then, normal image formation (the development process) is performed in a state illustrated in FIG. 2.

In the present embodiment, the winding shaft 13*k* is made of metal having a diameter of 3 to 6 mm.

As described above, in the present embodiment, in any case of when the developing device 13 is transported alone for replacement and when the developing device 13 is transported in the state of being installed in the image forming apparatus 1 at the time of shipment, the developer G (a preset developer) preliminarily stored in the developing device 13 is sealed by the sheet member 13*m*. As a result, the developer G (the preset developer) is prevented from leaking to the outside of the developing device 13 due to the vibration generated at the time of transportation.

In particular, in the present embodiment, as illustrated in FIG. 5A, the sheet member 13*m* covers the outer circumference of the developing roller 13*a* inside the developing device 13 to form the closed space before the winding of the sheet member 13*m* by the winding shaft 13*k* starts.

This configuration inhibits the developing roller 13*a* from carrying the developer G at the time of transportation. As a result, even if a user touches the developing roller 13*a*, the user is reliably prevented from getting soiled with developer G. Further, even when the image forming apparatus 1 in which the new developing device 13 is installed is shipped, the developer G carried on the surface of the developing roller 13*a* does not scratch the surface of the photoconductor drum 11.

Furthermore, in the present embodiment, as illustrated in FIGS. 2, 5A, and 5B, the opening 13*r*1 to remove the sheet member 13*m* from the inside of the developing device 13 is formed in the upper cover 13*r* which is not buried in the developer G. Thus, the developer G can be less likely to leak from the opening 13*r*1 during normal image formation, as compared with the case in which the opening is formed in a lower cover 13*u* buried in the developer G.

Note that, in the present embodiment, even if the developer G leaks from the opening 13*r*1 described above, a pressing cover (a pressing member) 13*s* is disposed to cover a space where the winding shaft 13*k* is disposed. Therefore, the developer G does not leak to the outside of the developing device 13.

In the present embodiment, the winding shaft 13*k* is rotated in a predetermined direction (counterclockwise in FIG. 5B) when the driving force is transmitted from the drive motor (the driver) to drive the developing device 13. The transmission of the driving force from the drive motor is shut off and the rotation of the winding shaft 13*k* is stopped after a predetermined time which is equal to or longer than the time when the winding of the sheet member 13*m* is completed. Here, "the predetermined time" described above is within a warm-up operation until the developing process is performed after the developing device 13 is installed in the image forming apparatus 1. That is, when a new developing device 13 is installed in the image forming apparatus 1 (or when the new image forming apparatus 1 in which the new developing device 13 is installed starts to operate), the drive motor starts to rotate the winding shaft 13*k* from the state in FIG. 5B, causing the winding shaft 13*k* to wind the sheet member 13*m* during the warm-up operation in which adjustment of the image formation condition is performed. Then, after the winding of the sheet member 13*m* is completed as illustrated in FIG. 2, the transmission of the driving force from the drive motor to the winding shaft 13*k* is shut off and the winding shaft 13*k* that has wound the sheet member 13*m* stops rotating. Thereafter, the normal image formation (the development process) is performed.

Further, when the winding shaft 13*k* winds the sheet member 13*m*, the developing roller 13*a* and the first and second conveying screws 13*b*1 and 13*b*2 are also driven, and the developing roller 13*a* having irregularities on the surface vibrates the sheet member 13*m*, thereby removing the developer G adhering to the sheet member 13*m*. Further, the tip of the partition 13*d* and the opening 13*r*1 through which the sheet member 13*m* passes is scraped off the developer G adhering to the surface of the sheet member 13*m*.

As described above, the winding shaft 13*k* stops rotating after the winding of the sheet member 13*m* is completed. Accordingly, the winding shaft 13*k* is not permanently rotated in conjunction with the driving of the developing device 13. Therefore, abnormal noise or excessive driving torque is prevented. In addition, when the normal image formation starts, since the rotation of the winding shaft 13*k* is stopped, vibration due to the rotation of the winding shaft 13*k* affecting the image formation is prevented.

Figure 6:
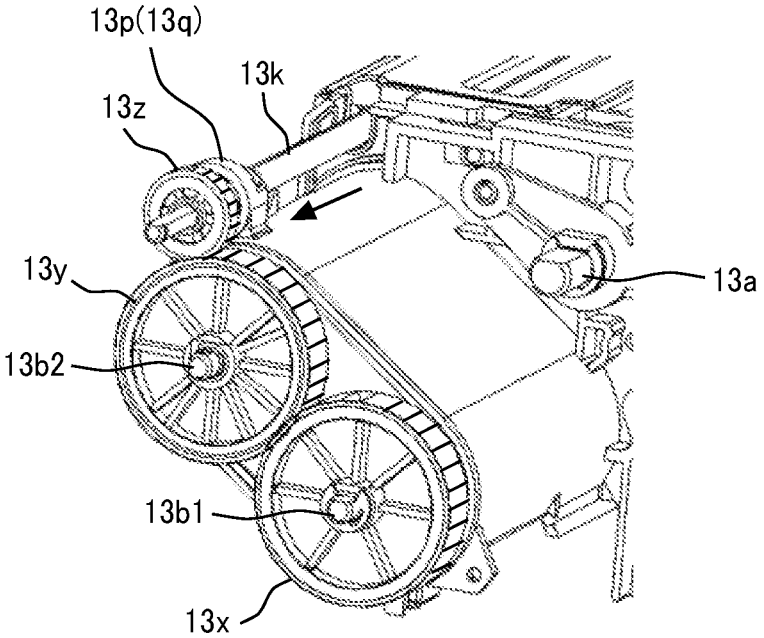
FIG. 6 is a perspective view of a part of the developing device as viewed from the side of the developing device.
Figure 7:
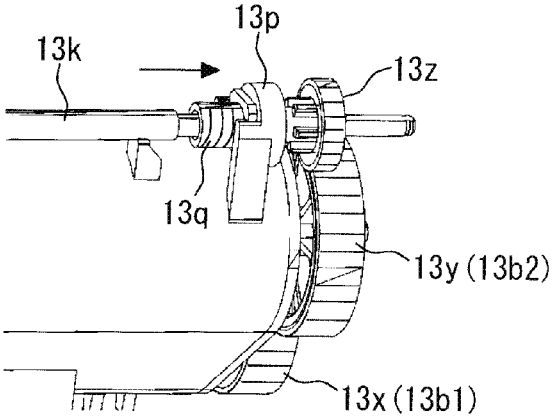
FIG. 7 is a perspective view of the part of the developing device as viewed from the back of the developing device.
Figure 8A:
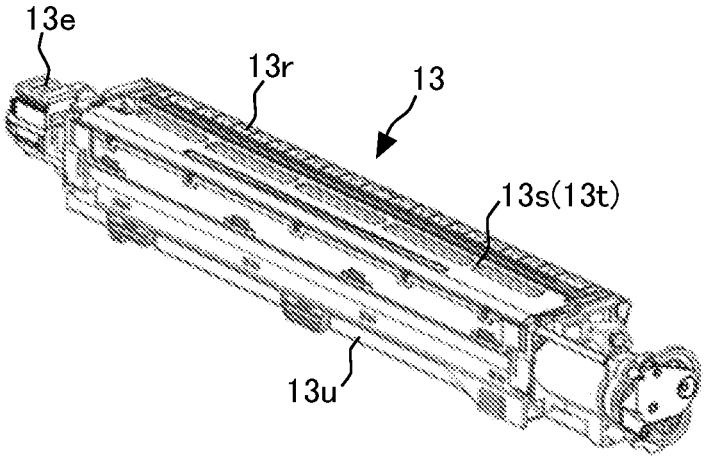
FIG. 8A is a perspective view of the developing device according to an embodiment of the present disclosure.
Figure 8B:
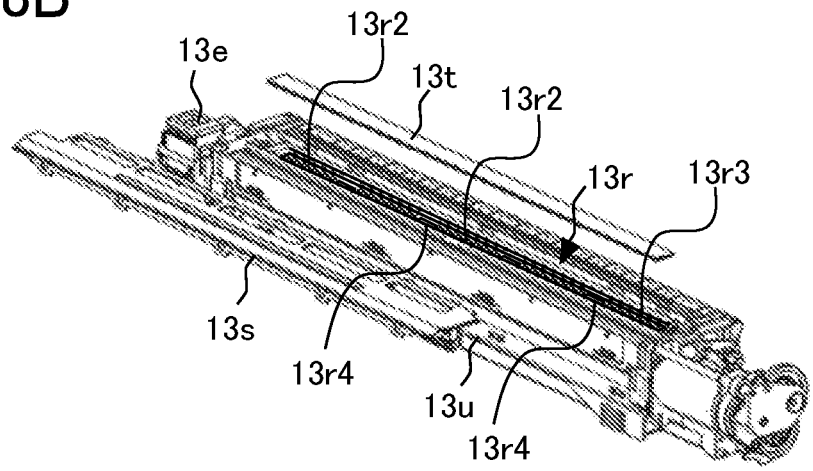
FIG. 8B is a perspective view of the developing device from which a pressing cover and a filter of the developing device are removed.

With reference to FIGS. 6 and 7, the mechanism to shut off the transmission of the driving force from the drive motor (the driver) to the winding shaft 13*k* after the predetermined time has elapsed is described in detail below.

As described above, in the developing device 13, the second conveying screw 13*b*2 as a rotator is rotated by the driving force transmitted from the drive motor (the driver) for the developing device 13 via the gear train. The third gear (the following gear) 13*z* meshed with the second gear (the driving gear) 13*y* is attached to the winding shaft 13*k*. The second gear (the driving gear) 13*y* is attached to the second conveying screw 13*b*2. Furthermore, a feed screw 13*q* is disposed on a part of the winding shaft 13*k* in the axial direction to engage a nut 13*p* secured to the ceiling portion of the developing device 13 to move the winding shaft 13*k* in the axial direction (the longitudinal direction).

The driving force is transmitted from the second gear (the driving gear) 13*y* to the third gear (the following gear) 13*z*, and the winding shaft 13*k* is rotated to screw the feed screw 13*q* to the nut 13*p*. The winding shaft 13*k* is moved in the axial direction (in the direction indicated by the arrows in FIGS. 6 and 7 and the longitudinal direction), and the second gear 13*y* disengages from the third gear 13*z* after a predetermined time has elapsed. As a result, the winding shaft 13*k* stops rotating. That is, the screw engagement between the feed screw 13*q* and the nut 13*p* progresses, and the third gear 13*z* slides in the axial direction along with the winding shaft 13*k*. When the third gear 13*z* reaches a position where the third gear 13*z* does not mesh with the second gear 13*y* (or the third gear 13*z* disengages from the second gear 13*y*), the transmission of the driving force is shut off and the winding shaft 13*k* stops rotating. The tooth width and rotation speed (the number of teeth) of the two gears (i.e., the second gear 13*y* and the third gear 13*z*), the screwing position and screwing length between the feed screw 13*q* and the nut 13*p* are set so as to achieve such an operation.

With this configuration, only the driving force to drive the winding shaft 13*k* can be shut off by the driving force of the drive motor to drive the developing device 13, without separately providing a motor to drive the winding shaft 13*k*, without shutting off the driving force to drive the developing roller 13*a* and the first and second conveying screws 13*b*1 and 13*b*2. Therefore, the size and weight of the developing device 13 can be reduced.

In the present embodiment, the third gear (the following gear) 13*z* attached to the winding shaft 13*k* meshes with the second gear 13*y* attached to the second conveying screw 13*b*2. However, the transmission of the driving force is not limited to the above-described embodiment, for example, the third gear (the following gear) 13*z* attached to the winding shaft 13*k* may mesh with the first gear 13*x* attached to the first conveying screw 13*b*1.

The configuration and operation of the developing device 13 according to the present embodiment are described below.

As described above with reference to FIG. 2, the developing device 13 according to the present embodiment includes the developing roller 13*a* opposed to the photoconductor drum (the image bearer) 11 and the upper cover 13*r* as the cover to cover the developing roller 13*a* above the developing device 13.

The upper cover 13*r* is disposed to cover the upper side of the developing device 13 (a range including the upper side of the developing roller 13*a*). The upper cover 13*r* functions as the exterior or the casing of the developing device 13 together with a lower cover 13*u* to cover a lower side of the developing device 13, and the pressing cover (the pressing member) 13*s* to cover the winding shaft 13*k* and a filter 13*t*. The pressing cover 13*s* is described in detail later. In the present embodiment, the upper cover 13*r*, the lower cover 13*u*, and the pressing cover 13*s* are made of a resin material such as acrylonitrile butadiene styrene (ABS) or polycarbonate (PC).

With reference to FIG. 2, in the present embodiment, a gap (a casing gap) H of 0.6 to 1.0 mm is provided between the developing roller 13*a* and the upper cover 13*r*.

Note that, if the casing gap H becomes smaller than 0.6 mm, the developer G carried on the developing roller 13*a* after the development process is not smoothly transported through the casing gap H between the developing roller 13*a* and the upper cover 13*r*, causing the developer G to leak to the outside of the developing device 13.

On the other hand, when the casing gap H is larger than 1.0 mm, the developer G carried on the developing roller 13*a* is not likely to be in sliding contact with the inner surface of the upper cover 13*r*, and a suction air flow toward the inside of the developing device 13 due to a pump action is hardly generated. As a result, toner scattering from the developing device 13 (which is scattering of toner to the periphery of the development area) is likely to occur.

Therefore, with the casing gap H kept within an appropriate range, leakage of the developer G and toner scattering can be reduced.

With reference to FIGS. 2, 8A, 8B, and 9, the upper cover 13*r* as the cover has the vent (an opening) 13*r*2 that enables air to flow inside and outside the developing device 13. The developing device 13 includes the filter 13*t* that covers the vent 13*r*2 of the upper cover (the cover) 13*r* to collect toner and ventilate.

In other words, a flow path to vent the air from the inside to the outside of the developing device 13 is formed in the upper cover 13*r*. The filter 13*t* is installed in the upper cover 13*r* to cover a part of the flow path. The filter 13*t* is made of a screen having a mesh size that is smaller than the particle diameter of the toner T or the carrier C and thus allows only air to pass through.

The internal pressure of the developing device 13 is likely to increase due to the suction air flow through the casing gap H described above, and if the internal pressure increases, toner scattering may occur from gaps of the developing device 13. On the other hand, in the present embodiment, since the vent 13*r*2 covered by the filter 13*t* is provided to collect the toner T, only air is vented while preventing the toner T from scattering to the outside. As a result, the increase of the internal pressure of the developing device 13 is minimized. That is, this configuration inhibits toner scattering caused by the increase of the internal pressure of the developing device 13.

Here, with reference to FIGS. 2 and 8A to 10D, in the present embodiment, the pressing cover 13*s* as the pressing member is detachably attached to the developing device 13 separately from the upper cover 13*r* and the lower cover 13*u*.

The pressing cover 13*s* as the pressing member engages with the upper cover 13*r* with the filter 13*t* installed in the vent 13*r*2, and the filter 13*t* is held between the pressing cover 13*s* and the upper cover 13*r*. In other words, the pressing cover 13*s* presses the filter 13*t* installed in the upper cover 13*r* from above to prevent the filter 13*t* from falling off.

Further, in the present embodiment, the pressing cover 13*s* is disposed so as to cover the winding shaft 13*k* with the upper cover 13*r*. As a result, most of the winding shaft 13*k* is not exposed to the outside of the developing device 13. Therefore, a problem that a user or a technician erroneously applies a strong external force to the winding shaft 13*k* that deforms the winding shaft 13*k* is prevented.

In the present embodiment, the pressing cover 13*s* is configured to engage the upper cover 13*r* by snap-on clipping.

The assembly procedure of the filter 13*t* and the pressing cover 13*s* and the winding of the sheet member 13*m* is additionally described with reference to FIGS. 10A to 10D.

Figure 10A:
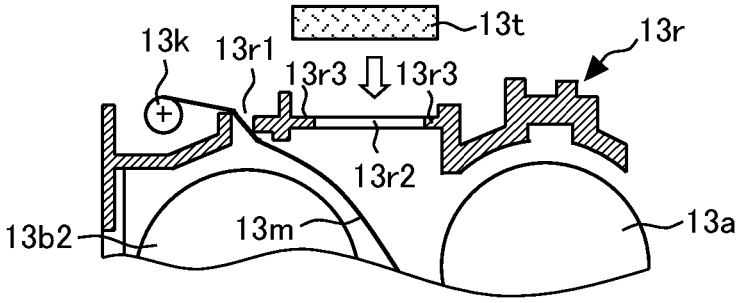
FIGS. 10A to 10D are enlarged views illustrating a process of assembling a main part of the developing device.
Figure 10B:
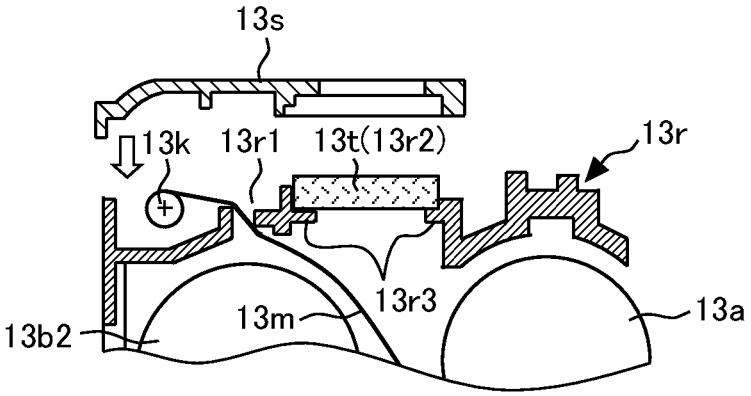

First, as illustrated in FIGS. 10A and 10B, in the manufacturing process at the factory, the filter 13*t* is installed in the developing device 13, in which the developer G as the preset developer is contained and the sheet member 13*m* has been installed, to cover the vent 13*r*2.

Figure 10C:
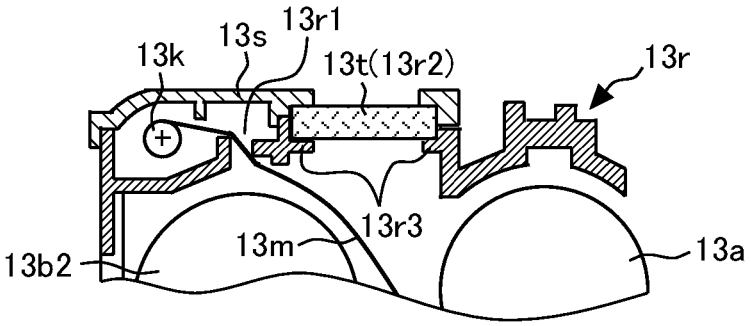

Thereafter, as illustrated in FIGS. 10B and 10C, the pressing cover 13*s* is attached to the developing device 13 in which the filter 13*t* is set. Then, the developing device 13 in the state illustrated in FIG. 10C is shipped from the factory.

Figure 10D:
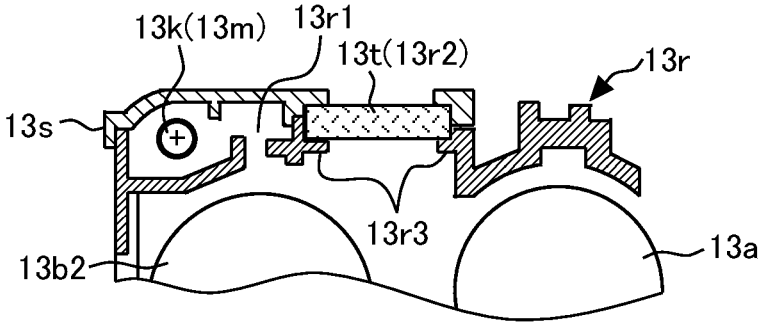

Thereafter, as illustrated in FIG. 10D, the sheet member 13*m* is wound up at the user's site.

In the case in which the filter 13*t* in the used developing device 13 as illustrated in FIGS. 2 and 10D is replaced, the pressing cover 13*s* is removed from the developing device 13 in the state as illustrated in FIGS. 2 and 10D, and then the filter 13*t* is removed. A filter 13*t* for replacement is installed instead of the removed filter 13*t*, and finally the pressing cover 13*s* engages with the developing device 13.

Figure 11:
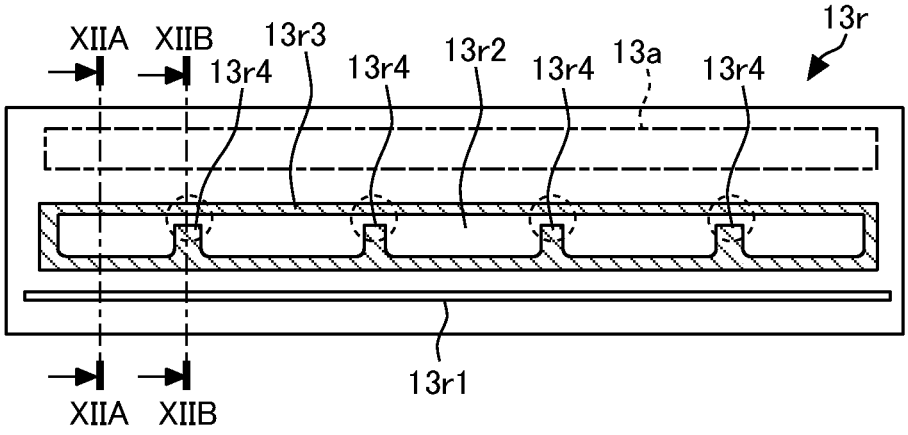
FIG. 11 is a schematic top view of a cover of the developing device.
Figure 12A:
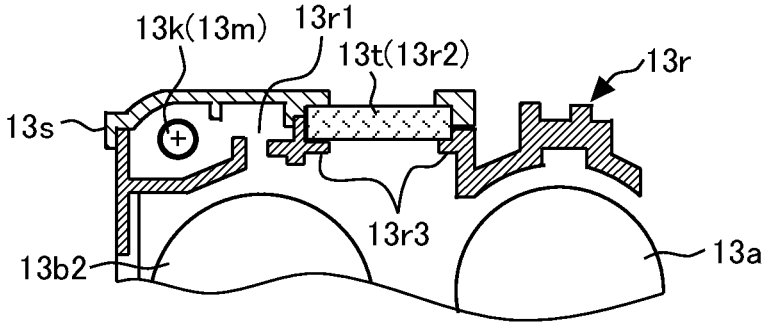
FIGS. 12A and 12B are schematic cross-sectional views of the main part of the developing device along lines XIIA-XIIA and XIIB-XIIB illustrated in FIG. 11, respectively.
Figure 12B:
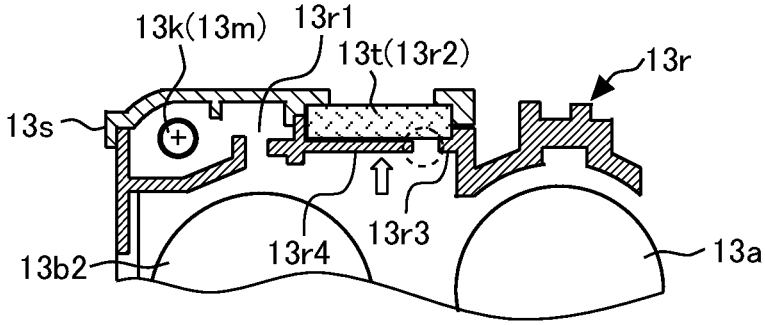

With reference to FIGS. 11, 12A, and 12B, in the developing device 13 according to the present embodiment, the upper cover 13*r* as the cover includes a circumferential support 13*r*3 and projecting supports 13*r*4 to support the filter 13*t* from below.

The circumferential support 13*r*3 has a substantially rectangular ring shape so as to support an edge of the bottom surface of the substantially rectangular filter 13*t* around the entire circumference of the filter 13*t*.

In addition, the circumferential support 13*r*3 outlines the vent 13*r*2. Specifically, the circumferential support 13*r*3 is opened at the center thereof in a substantially rectangular shape, and the opening functions as the vent 13*r*2.

The projecting support 13*r*4 projects from the one end of the vent 13*r*2 (i.e., the lower side in the transverse direction of the vent 13*r*2 in FIG. 11) toward the other end of the vent 13*r*2 (i.e., the upper side in the transverse direction in FIG. 11) at a part of circumferential support 13*r*3 of the upper cover 13*r* in the longitudinal direction (i.e., the left and right direction in FIG. 11) to block the vent 13*r*2.

In other words, the projecting support 13*r*4 projects from one end of the circumferential support 13*r*3 toward the other end of the circumferential support 13*r*3 in the transverse direction (i.e., a short-side direction) of the circumferential support 13*r*3.

Furthermore, the projecting support 13*r*4 is cantilevered on the one end (i.e., the lower side in the top and bottom direction in FIG. 11) by the upper cover 13*r*, and a gap enclosed by the dashed circles in FIGS. 11 and 12B is formed between a tip of the projecting support 13*r*4 and the other end of the circumferential support 13*r*3 (i.e., an inner edge of the upper cover 13*r* on the other end of the vent 13*r*2) in the transverse direction.

In other words, the one end of the projecting support 13*r*4 in the transverse direction is a secured end coupled to the inner circumference of the circumferential support 13*r*3, and the other end of the projecting support 13*r*4 in the transverse direction is a free end spaced from the inner circumference of the circumferential support 13*r*3.

In the present embodiment, a plurality of projecting supports 13*r*4 is disposed at intervals in the longitudinal direction. Specifically, in the present embodiment, the four projecting supports 13*r*4 are spaced each other at substantially equal intervals in the longitudinal direction.

In the present specification, the "longitudinal direction" is a direction substantially corresponding to the direction of the axis of rotation of the developing roller 13*a*. Further, the "transverse direction (or the short-side direction)" is a direction substantially perpendicular to the longitudinal direction.

As described above, since the upper cover 13*r* includes the projecting support 13*r*4, upward force indicated by the white arrow in FIG. 12B efficiently acts on the upper cover 13*r*. Such upward force is mainly reaction force of the force generated by the filter 13*t* sandwiched and compressed between the pressing cover 13*s* and the upper cover 13*r* (i.e., force by the free end of the projecting support 13*r*4 bounced). Such upward force acts efficiently because the projecting support 13*r*4 is cantilevered by the upper cover 13*r*. In the case of supports supported at both ends so as to cover the vent 13*r*2 from the one end to the other end in the transverse direction of the upper cover 13*r*, such force does not act efficiently.

Further, since such upward force acts on the upper cover 13*r*, the upper cover 13*r* is hardly bent downward. As a result, a problem that the gap (the casing gap) H between the developing roller 13*a* and the upper cover 13*r* become narrower than the target range is prevented. Therefore, problems are prevented that the developer G carried on the developing roller 13*a* after the development process is not transported smoothly to the casing gap H and the developer G leaks out of the developing device 13 because the casing gap H is too narrow.

In particular, in the present embodiment, the upper cover 13*r* is made of a relatively thin resin material to reduce the weight and cost of the developing device 13. Therefore, as compared with the case in which the upper cover 13*r* is made of a heavy metal material, the mechanical strength of the upper cover 13*r* decreases, and the deformation of the upper cover 13*r* that causes the casing gap H to narrow is likely to occur, that is, the upper cover 13*r* is bent convexly downward. Therefore, the effect of the projecting support 13*r*4 is enhanced as in the present embodiment.

Further, in the present embodiment, since the upper cover 13*r* includes the circumferential support 13*r*3 to support the edge of the filter 13*t* around the entire circumference of the filter 13*t*, the filter 13*t* is supported by the upper cover 13*r* in a well-balanced manner.

Note that, as illustrated in FIGS. 12A and 12B, a recess is formed in the upper cover 13*r* so that the side surface of the filter 13*t* is surrounded around the entire circumference of the filter 13*t*. The filter 13*t* is fitted into the recess and is supported in a well-balanced manner by the circumferential support 13*r*3 and the projecting supports 13*r*4.

In the present embodiment, the developing roller 13*a* is disposed on the other end in the transverse direction with respect to the vent 13*r*2 (i.e., the upper side in FIG. 11, the right side in FIGS. 12A and 12B, and the side where the free end of the projecting support 13*r*4 is disposed).

As a result, as compared with the case in which the secured end of the projecting support 13*r*4 is disposed on the side of the developing roller 13*a*, it is easy to get effect to prevent the casing gap H from narrowing due to the force in the direction indicated by the white arrow in FIG. 12B acting on the upper cover 13*r*. This is because the above-described force in the direction indicated by the white arrow in FIG. 12B is larger on the free end than on the secured end of the projecting support 13*r*4.

Further, in the present embodiment, the upper cover 13*r* has the opening 13*r*1 disposed on the one end in the transverse direction with respect to the vent 13*r*2 (i.e., the lower side in FIG. 11, the left side in FIGS. 12A and 12B, and the side where the secured end of the projecting support 13*r*4 is disposed). The opening has a substantially rectangular shape extending in the longitudinal direction to wind the sheet member 13*m*.

Thus, since the opening 13*r*1 is disposed on the secured end of the projecting support 13*r*4 in the upper cover 13*r*, the upper cover 13*r* hardly deforms on the secured end so as to follow the pressing force of the filter 13*t* applied to the secured end of the projecting support 13*r*4.

Figure 9:
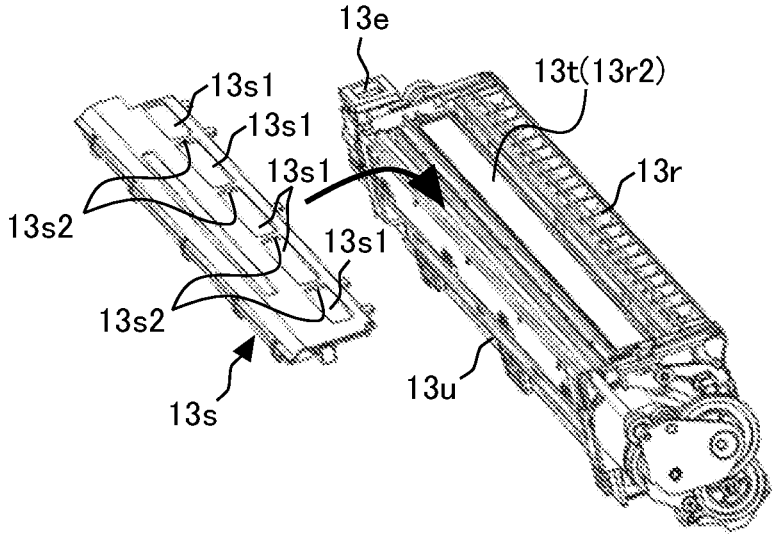
FIG. 9 is a perspective view illustrating a state in which the pressing cover is attached to the developing device.

Further, with reference to FIG. 9, in the present embodiment, the pressing cover 13*s* has a plurality of ventilation openings 13*s*1 conforming to the shape of vent 13*r*2 of the upper cover 13*r*. The ventilation openings 13*s*1 are separated from each other at a position corresponding to the projecting supports 13*r*4 in the longitudinal direction.

Specifically, the pressing cover 13*s* is provided with four ventilation openings 13*s*1 divided longitudinally so as to match the pitch of the projecting supports 13*r*4 of the upper cover 13*r*. More specifically, the pressing cover 13*s* includes partitions 13*s*2 for partitioning the adjacent ventilation openings 13*s*1 so as to correspond to positions at which the projecting supports 13*r*4 are disposed in the longitudinal direction.

With such a configuration, the vent 13*r*2 of the upper cover 13*r* is not blocked by the pressing cover 13*s*, thereby providing good ventilation in the developing device 13.

Further, with reference to FIGS. 9 to 10D, in the present embodiment, the pressing cover 13*s* includes a pressing portion along the circumference of the filter 13*t* to press an edge of the upper surface of the filter 13*t* in accordance with the shape of the circumferential support 13*r*3 of the upper cover 13*r*.

As a result, the filter 13*t* is held in a well-balanced manner between the pressing cover 13*s* and the upper cover 13*r*.

As the above-described embodiments, the developing device 13 configured to develop the latent image formed on the surface of the photoconductor drum 11 as an image bearer includes the developing roller 13*a* opposed to the photoconductor drum 11, the upper cover 13*r* as a cover to cover the developing roller 13*a* above the developing device 13, the filter 13*t* to cover the vent 13*r*2 of the upper cover 13*r*, and the pressing cover 13*s* to hold the filter 13*t* between the upper cover 13*r* and the pressing cover 13*s* as a pressing member. The upper cover 13*r* includes the projecting support 13*r*4 that projects from one end of the vent 13*r*2 in the transverse direction of the vent 13*r*2 toward the other end of the vent 13*r*2 in the transverse direction of the vent 13*r*2 at a part of the upper cover 13*r* in the longitudinal direction of the developing roller 13*a* to block the vent 13*r*2 The projecting support 13*r*4 is cantilevered by the upper cover 13*r* at the one end of the vent 13*r*2 in the transverse direction to support the filter 13*t*. The gap is provided between the tip of the projecting support 13*r*4 of the cover 13*r* and the inner edge of the upper cover 13*r* on the other end of the vent 13*r*2 in the transverse direction of the vent 13*r*2.

As a result, the problem that the casing gap H between the developing roller 13*a* and the upper cover 13*r* becomes too narrow can be prevented.

Therefore, according to the present disclosure, a developing device in which a gap between a developing roller and a cover hardly becomes narrow, a process cartridge, and an image forming apparatus incorporating the developing device can be provided.

It is to be noted that, in the above-described embodiments, the second conveying screw 13*b*2 serving as the collection screw is disposed above the first conveying screw 13*b*1 serving as the supply screw, and the doctor blade 13*c* is disposed below the developing roller 13*a* in the two-component type developing device 13. However, the configuration of the developing device to which the present disclosure is applied is not limited to the above-described configurations. The present disclosure can be applied to a developing device employing a two-component development method in which a second conveying screw serving as a collection screw is disposed below a first conveying screw serving as a supply screw, and a doctor blade is disposed above a developing roller, or another developing device employing two-component development method in which a plurality of conveyors is horizontally arranged in parallel. Further, the present disclosure can be applied to yet another developing device employing a one-component development method using only toner without carrier as a developer.

In the above-described embodiments, the present disclosure is applied to the developing device 13 in which the developing roller 13*a* is disposed across a gap from the photoconductor drum 11 as the image bearer. Alternatively, the present disclosure can be applied to a developing device employing the contact type one-component development method, in which a developing roller contacts an image bearer.

In such configurations, effects similar to those described above are also attained.

Further, the present disclosure is applied to the developing device 13 that is separately installed in the image forming apparatus 1. Alternatively, the present disclosure is not limited to the above described configuration and can be applied to a developing device that constitutes a process cartridge together with other components. In this case, workability of maintenance of the image forming unit can be improved.

It is to be noted that the term "process cartridge" used in the present disclosure means a unit including an image bearer and at least one of a charger to charge the image bearer, a developing device to develop latent images on the image bearer, and a cleaner to clean the image bearer united together and designed to be removably installed together in the image forming apparatus.

Further, in the above-described embodiments, the pressing cover 13*s* as the pressing member is configured separately from the upper cover 13*r* as the cover, but a pressing member (a pressing cover) and an upper cover (a cover) together can constitute a single unit.

Further, in the above-described embodiments, since the feed screw 13*q* is disposed on the winding shaft 13*k*, the winding shaft 13*k* is moved to the position where the second gear 13*y* and the third gear 13*z* disengage from each other, thereby shutting off the driving force from the driver. Alternatively, without the feed screw 13*q*, the second gear (the driving gear) 13*y* and the third gear (the following gear) 13*z* can be helical gears. In this case, the third gear (the following gear) 13*z* disposed on the winding shaft 13*k* receives a component of force to move in the axial direction due to meshing with the second gear (the driving gear) 13*y*. As a result, the winding shaft 13*k* is moved to a position where the third gear (the following gear) 13*z* disengages from the second gear (the driving gear) 13*y*, thereby shutting off the driving force from the driver.

In above-described embodiments, the winding shaft 13*k* is automatically rotated by the driver, but a winding shaft that is manually rotated can be used.

In such configurations, effects similar to those described above are also attained.

The above-described embodiments are illustrative and do not limit the present disclosure. Thus, numerous additional modifications and variations are possible in light of the above teachings. It is therefore to be understood that within the scope of the present disclosure, the present disclosure may be practiced otherwise than as specifically described herein. The number, position, and shape of the components described above are not limited to those embodiments described above. Desirable number, position, and shape can be determined to perform the present disclosure.

What is claimed is:

1. A developing device configured to develop a latent image formed on an image bearer, the developing device comprising:

a developing roller opposed to or in contact with the image bearer;

a cover configured to cover the developing roller from above the developing roller, the cover including a projecting support and having a vent to allow ventilation of the developing device;

a filter configured to cover the vent of the cover to filter air and collect toner passing through the vent; and a pressing member configured to engage the cover in which the filter is installed and hold the filter between the pressing member and the cover, the projecting support:

projecting from one end of the vent in a transverse direction of the vent toward other end of the vent in the transverse direction of the vent at a part of the cover in a longitudinal direction of the developing roller, to block the vent;

cantilevered by the cover on the one end of the vent in the transverse direction of the vent; and configured to support the filter, a gap is provided between a tip of the projecting support and an inner edge of the cover on the other end of the vent in the transverse direction of the vent.

2. The developing device according to claim 1, wherein a plurality of projecting supports including the projecting support is spaced each other in the longitudinal direction of the developing roller.

3. The developing device according to claim 1, wherein the cover includes a circumferential support configured to support the filter around a circumference of the filter, wherein the projecting support projects from one end of the circumferential support in the transverse direction of the vent toward other end of the circumferential support in the transverse direction of the vent.

4. The developing device according to claim 1, wherein the developing roller is disposed on the other end of the vent in the transverse direction with respect to the vent.

5. The developing device according to claim 1, wherein the cover has an opening disposed on the one end of the vent in the transverse direction with respect to the vent.

6. The developing device according to claim 5, further comprising:

a sheet member configured to isolate an inside of the developing device to form a closed space inside the developing device, the closed space configured to contain a developer; and a winding shaft configured to rotate in a predetermined direction and wind the sheet member in a direction perpendicular to an axis of rotation of the winding shaft to remove the sheet member from the inside to an outside of the developing device through the opening when the developing device starts to be used in an image forming apparatus, and wherein the pressing member covers the winding shaft between the cover and the pressing member.

7. The developing device according to claim 1, wherein the pressing member has a plurality of ventilation openings in the cover, wherein the plurality of ventilation openings is separated from each other at a position corresponding to the projecting support in the longitudinal direction of the developing roller.

8. The developing device according to claim 1, further comprising a developer regulator opposed to the developing roller below the developing roller and configured to adjust an amount of developer carried on the developing roller.

9. A process cartridge configured to be removably installable in an image forming apparatus, the process cartridge comprising:

the developing device according to claim 1; and the image bearer combined with the developing device as a single unit.

10. An image forming apparatus comprising:

the developing device according to claim 1; and the image bearer.

* * * * *